United States Patent [19]

Dold

[11] 4,187,510

[45] Feb. 5, 1980

[54] DEVICE FOR RECORDING VEHICLE SPEEDS

[75] Inventor: Berthold Dold, Schramberg, Fed. Rep. of Germany

[73] Assignee: Kienzle Apparate GmbH, Villingen, Fed. Rep. of Germany

[21] Appl. No.: 896,230

[22] Filed: Apr. 13, 1978

[30] Foreign Application Priority Data

Apr. 27, 1977 [DE] Fed. Rep. of Germany ..... 2718681

[51] Int. Cl.[2] ..... G07C 5/12

[52] U.S. Cl. ..... 346/21; 346/137

[58] Field of Search ..... 346/21, 18, 145, 137

[56] References Cited

U.S. PATENT DOCUMENTS

| | | | |
|---|---|---|---|
| 1,681,460 | 8/1928 | Bruhn | 346/21 |
| 1,700,399 | 1/1929 | Bruhn | 346/21 X |
| 3,184,748 | 5/1965 | Muller | 346/21 |

*Primary Examiner*—Joseph W. Hartary

*Attorney, Agent, or Firm*—Toren, McGeady and St. Anger

[57] ABSTRACT

In a device for recording vehicle speeds on a record carrier, the carrier includes a recording layer of a suitable colored paste and is combined with a lid as a unit which is removably mounted on the device housing. The recording layer is located between the lid and the record carrier. The circumferential periphery of the lid and of the record carrier are interconnected. In this arrangement at least the record carrier is transparent.

6 Claims, 5 Drawing Figures

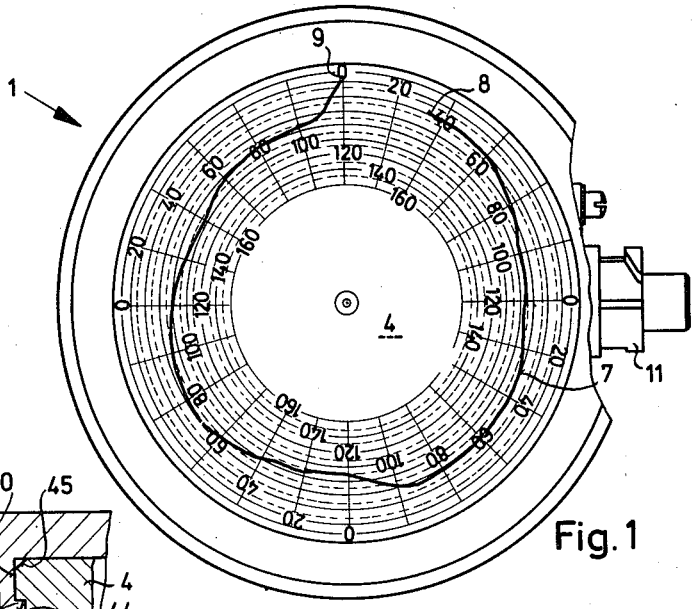
Fig. 1
Fig. 5
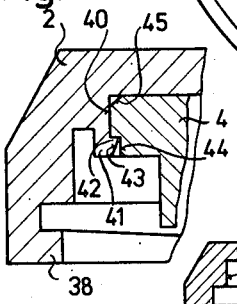
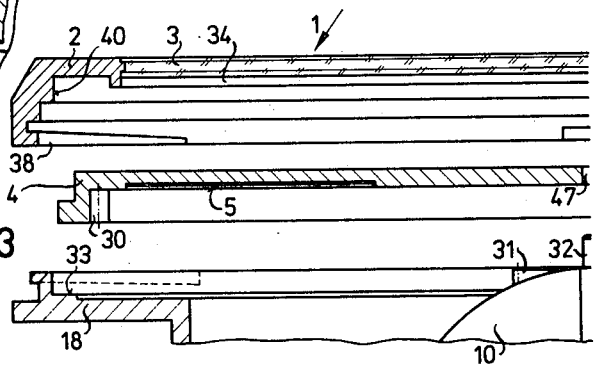
Fig. 3
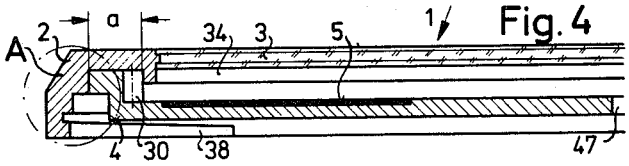
Fig. 4

DEVICE FOR RECORDING VEHICLE SPEEDS

SUMMARY OF THE INVENTION

The present invention is directed to a device for recording vehicle speeds and, more particularly, it concerns a unit formed of a lid and a record carrier on which the speed is recorded which can be removably mounted on the device housing.

In recording devices which record the speed of a vehicle as it travels over a certain distance, for instance its last 500 meters of travel, continuous erasure of the recording is provided to afford an accident recorder which displays the speed travel on a large scale. When used for this purpose, it must be possible to remove the recorded information from the recording device and to preserve it without damaging or destroying the record carrier.

The ability to retain the recording is not possible with magnetic or electrostatic recording methods. Further, a photographic reproduction of visual recordings does not represent a satisfactory solution as manipulation of the recorded information is possible. Various other mechanical methods are known to represent the speed wherein tongues or pins of a suitable material represent the diagram line. Although magnetic and electric fields do not influence these recordings, such methods can only be effected by a rather expensive recording device construction and the recordings themselves are contained in rather large and unwieldly cassettes, unsuitable to be removed from the device.

In another known recording method, such as described in German Pat. Nos. 478 265 or 1 290 730, the diagram line is produced by displacing a colored paste deposited in a thin layer on a suitable record carrier. This recording method allows the information to be collected in a cassette which requires less space and is easier to handle.

This last recording method is also advantageous because the recordings are resistant to electrical or magnetic fields and can be produced with satisfactory quality over a wide climatic range. Neither a transducer nor a developing process is needed to read the diagram line. The line recorded on the carrier can be suitably preserved within a cassette which is easily handled, copies can be made of the recorded information, and the original can be stored in accident files so that this recording method appears to be the optimum for securing the recorded speed data for its desired purpose.

Cassettes disclosed in the above-mentioned patents, however, are relatively expensive to produce and, due to their size and weight, are also unsatisfactory for handling and filing purposes. These known cassettes are not sufficiently protected against tampering, since they have openings through which the recording pencil or stylus passes and various other openings for securing the cassette and for the engagement of operating means to arrest the record carrier within the cassette. To avoid a large cut-out in the cassette for the erasing device, the erasing device is made a part of the cassette. This, however, has a particularly unfavorable effect on the size and weight of the cassette. Another disadvantage is that such cassettes, which are relatively expensive units, must be kept in readiness as spare parts which means increased costs for production and storage. Moreover, in instances where only the record carrier has to be exchanged because its paste layer has modified its characteristic because of time, it would be very uneconomical to replace the entire cassette.

It is the primary object of the present invention to provide a cassette which overcomes the problems experienced in the past and affords a cassette which can be easily handled and stored.

In accordance with the present invention, the cassette is formed of a lid and a record carrier constituting an inseparable unit so that, after being removed from the recording device, the recording layer is located between the lid and the record carrier.

In this arrangement, the recording surface on the record carrier is accessible when the unit is removed from the recording device. However, this is not a disadvantage, since generally the record carriers are removed by an authorized person, for instance, a police official. By assembling the lid and the record carrier as a unit, a cassette is produced which can be made of a suitable plastic material and can be extremely flat and lightweight. As a result, such a cassette is easy to handle and can, if necessary, be filed. Furthermore, the cassette can be replaced at very little expense, since apart from the lid and the record carrier it contains no other parts. Since it has no openings for the engagement of any functional parts, it affords a high degree of security against tampering. Without providing any additional costs for production and assembly, the parts forming the cassette can be provided with detents interengaging the parts so that they are inseparable without destruction.

The various features of novelty which characterize the invention are pointed out with particularity in the claims annexed to and forming a part of this disclosure. For a better understanding of the invention, its operating advantages and specific objects attained by its use, reference should be had to the accompanying drawings and escriptive matter in which there are illustrated and described preferred embodiments of the invention.

BRIEF DESCRIPTION OF THE DRAWINGS

In the drawings:

FIG. 1 is a plan view, partly broken away, of a recording device embodying the present invention;

FIG. 3 is a partial sectional view showing several parts of the recording device separated from one another;

FIG. 4 is a partial cross-sectional view of the assembled parts; and

FIG. 5 is an enlarged detail view of the encircled part A in FIG. 4.

DETAIL DESCRIPTION OF THE INVENTION

Figure 2:
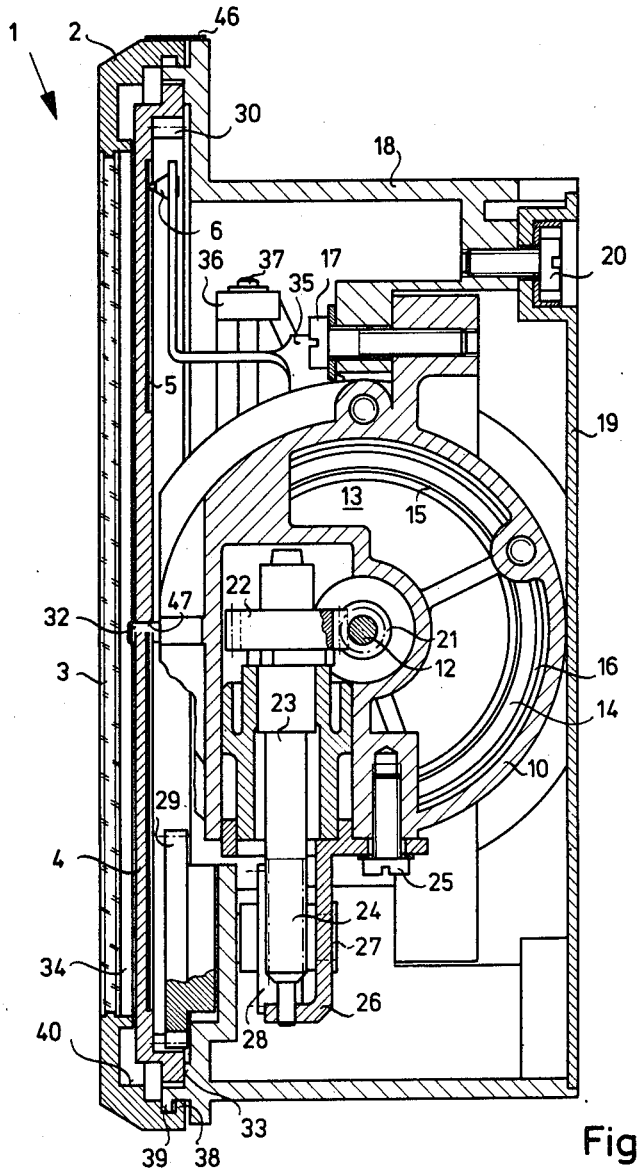
FIG. 2 is a cross-sectional view of the recording device.

FIG. 1 illustrates the front face of a recording device of the above described kind. The device is closed by a lid 1 formed of translucent material or, as shown in the other figures, of a ring 2 in which a transparent plate 3 is set. A record carrier 4 is located within the device and is visible through the transparent plate 3. In an embodiment where the lid is transparent, the record carrier 4 is necessarily also translucent or transparent and provided with distance and speed coordinates bearing no reference numerals. The record carrier 4 is driven in accordance with the distance covered as will be described subsequently. A recording layer 5 is formed on the surface of the record carrier and consists of a colored paste. The recording layer 5 is located on the surface of the record carrier 4 facing toward the interior of the device, so that a recording stylus 6 resting against the layer 5 on the carrier can be displaced in the radial direction in accordance with the vehicle speed for producing a line 7 by pushing away or displacing the colored paste. By means of a firmly arranged erasing device, not shown, but disclosed in the above-mentioned German Pat. No. 1 290 730, located in the space between the terminal point 8 and the starting point 9 of the diagram line 7, which is at the zero line of the speed scale when the vehicle is stopped, the diagram line is continuously erased when the record carrier is moved whereby the colored paste is evenly distributed.

By means of a flexible shaft, such as used in a tachometer or in a tachograph, the record carrier is driven. Furthermore, a speed measuring system is driven to produce the speed dependent movement of the recording stylus 6. As shown in FIG. 2, a housing 10 contains the measuring system and includes a suitable connection part 11, note FIG. 1, for the flexible shaft.

FIG. 2 affords a cross-sectional view of the housing 10 illustrating the elements of the eddy current system of the measuring device. A measuring magnet 13 is fastened to a shaft 12 driven by the flexible shaft. The eddy current cup 14 is provided in a known manner with rings 15 and 16 which serve as temperature compensation means and also for directing the magnetic flux. Fastening screws 17 connect the housing 10 of the measuring system to the housing 18 of the recording device. Plate 19, fastened by several screws, note screw 20 shown with a lead seal, closes the back face of the recording device.

The record carrier 4 is driven by means of a shaft 12, a worm 21 fastened to the shaft and a worm wheel 22 in engagement with the worm. In turn, the worm wheel 22 is fastened to a shaft 23 suitably mounted in the housing and provided with a worm 24. A bearing part 26 is fastened by means of a screw, mounting the shaft 23 on the housing 10. Bearing part 26 is also provided with another bearing for a shaft 27 on which a worm wheel 28 is fastened, which worm wheel is in engagement with the worm 24. Connected to the shaft 27 via a one-way-clutch, not shown, is a spur gear 29 in engagement with the toothing 30 formed on the inwardly facing periphery of the record carrier 4. A ratchet wheel 31 is mounted in the housing 18, as can be seen in FIG. 3, and is also in engagement with the record carrier with respect to its toothing 30.

The record carrier 4 includes a centrally located mounting bore 47 which fits on a shaft 32. Guiding the record carrier 4 at its outer periphery is a ring-shaped surface 33 on the housing 18. Further, guidance is also provided by a ring-shaped projection 34 formed on the lid 1. To complete the description, it should be noted that the recording stylus 6 is fastened to a slide 35, which is known from tachographs, and is mounted in a bracket 36 slidable with respect to guide bars 37 and disposed in driving connection with an output shaft, not shown, of the measuring system.

In FIG. 3, the lid 1 is connected by a bayonet joint to the housing 18 of the recording device by means of several ribs 38 on the lid and corresponding radial projections 39 on the housing 18, note the lower end of FIG. 2. After the lid 1 is disconnected from the housing 18, the record carrier 4 can be easily removed. In FIG. 4 a cassette is illustrated in which the recording layer 5 is no longer accessible, since unlike the arrangement shown in FIG. 3, the surface of the recording layer is reversed and faces outwardly toward the lid 1 and not inwardly toward the interior of the housing 18 as in FIG. 2. In other words, the lid 1 and the record carrier 4 are assembled in the reverse position in FIG. 4 to that shown in FIG. 2. The measurement "a", see FIG. 4, between the ring-shaped surface 40 on the lid 1 and the periphery of the ring-shaped projection 34, corresponds to the measurement between the outside diameter of the record carrier 4 and the radially inner edge of its toothing 30, these parts being assembled together by manually operated pressure. Another connection which allows higher production tolerances is shown in FIG. 5, which is an enlarged view of the encircled portion A in FIG. 4. In this arrangement, the ring-shaped surface 40 on the lid is undercut at its lower or axially inner portion so that an axially extending annular projection 41 is formed. The projection 41 has radially inwardly extending noses 42 and a radially outwardly sloping surface 43 extending from the noses 42 so that when the lid and record carrier are assembled together, the noses 42 grip the record carrier below a shoulder formed by the recessed portion 44 on the carrier. The illustrated detent connection can be varied in that the annular projection 41 does not surround the entire periphery of the lid but is subdivided into several sectors so that separate arc-shaped detent tongues result. It is also advantageous when the outside diameter of the lid 1 and of the housing 18 are the same, since in such an arrangment the recording device can be sealed by a suitable adhesive foil 46, note the upper portion of FIG. 2.

While specific embodiments of the invention have been shown and described in detail to illustrate the application of the inventive principles, it will be understood that the invention may be embodied otherwise without departing from such principles.

What is claimed is:

1. Recording device for vehicles comprising a housing, a lid removably mounted on said housing, said lid including a ring forming the outer circumferential periphery of said lid and a cover part extending across said ring, said ring shaped to interengage with said housing so that said ring can be releasably disengaged from said housing, a record carrier located in said housing under said lid, said record carrier having an eraseable recording layer thereon formed of a suitable paste for recording speeds of a vehicle, means within said housing for driving said record carrier in accordance with at least one of time and distance traveled, said record carrier is removably mounted in said housing and is arranged to prevent tampering with the recording layer, means on said ring and said record carrier for interconnecting said lid and record carrier as an inseparable unit so that both parts can be removed as a unit from said housing of the recording device, said unit having a first outer surface and a second outer surface each extending transversely of the axis of said ring with said cover part forming the first outer surface and said record carrier forming the second outer surface, said record carrier having a surface facing toward the cover part of said lid and facing in the opposite direction from the second outer surface, and said recording layer formed on the surface of said record carrier facing said cover part so that the recording layer is located between the lid and the record carrier.

2. Recording device as set forth in claim 1, wherein at least said record carrier is transparent.

3. A device, as set forth in claim 2, wherein said cover part comprises a transparent plate mounted in said ring so that the recording layer on said record carrier is visible through said lid.

4. Recording device, as set forth in claim 1, wherein said means for interconnecting said lid and record carrier comprises that said ring having a radially inwardly facing circumferentially extending peripheral surface, said record carrier having a radially outwardly facing circumferentially extending peripheral surface, said inwardly facing peripheral surface on said ring being arranged to interlock with the outwardly facing peripheral surface on said record carrier for locking said record carrier within said lid so that said lid and record carrier are removable as a unit from said housing.

5. Recording device, as set forth in claim 4, wherein the radially inwardly facing peripheral surface of said ring has a projection extending radially inwardly from the remainder of the inwardly facing peripheral surface, said projection forming a shoulder extending transversely of the axial direction of said ring, and said projection including a sloping surface extending in the axial direction of said ring and extending from the radially inner end of said shoulder and diverging relative to the axis of said ring to the opposite end of said projection spaced from said shoulder and located more remote from the first outer surface of said lid, and the outer circumferentially extending peripheral surface of said record carrier having a radially inwardly formed recess forming a shoulder and the shoulder on said projection on said ring being engageable with the shoulder on the outer peripheral surface of said record carrier for interengaging said lid and record carrier, the radially inner diameter of said projection on said ring being smaller than the radially outer diameter of said shoulder on the outer peripheral surface of said record carrier.

6. Recording device, as set forth in claim 1, wherein said ring on the radially outer circumferential periphery thereof and the radially outer periphery of said housing adjacent the circumferential periphery of said lid having the same diameter, and a foil adhesively secured to said lid and said housing and bridging the joint between said lid and said housing at the radially outer circumferential periphery of said lid.

* * * * *